US007267455B2

(12) United States Patent
Chernoff et al.

(10) Patent No.: US 7,267,455 B2
(45) Date of Patent: Sep. 11, 2007

(54) DEVICE FOR VIEWING MEDIA THROUGH FALLING LIQUID

(76) Inventors: Adrian Bradley Chernoff, 6672 Gunpark Dr., Suite 201, Boulder, CO (US) 80301; Seth David Smith Chernoff, 6672 Gunpark Dr., Suite 201, Boulder, CO (US) 80301; Stacey Lynn Smith Chernoff, 6872 Gunpark Dr., Suite 201, Boulder, CO (US) 80301

( * ) Notice: Subject to any disclaimer, the term of this patent is extended or adjusted under 35 U.S.C. 154(b) by 105 days.

(21) Appl. No.: 11/190,429

(22) Filed: Jul. 27, 2005

(65) Prior Publication Data

US 2006/0023469 A1 Feb. 2, 2006

Related U.S. Application Data

(60) Provisional application No. 60/591,443, filed on Jul. 27, 2004.

(51) Int. Cl.
*F21W 121/02* (2006.01)

(52) U.S. Cl. ..... 362/253; 362/96; 239/17; 239/18; 239/20; 40/406

(58) Field of Classification Search ..... 362/101, 362/96, 253; 239/17, 18, 20, 22, 23, 211; 40/406

See application file for complete search history.

(56) References Cited

U.S. PATENT DOCUMENTS

| | | | | |
|---|---|---|---|---|
| 4,747,538 A * | 5/1988 | Dunn et al. | ..... | 239/20 |
| 6,311,898 B1 * | 11/2001 | Gruff | ..... | 239/17 |
| 2004/0112977 A1 * | 6/2004 | Fisher | ..... | 239/17 |

* cited by examiner

*Primary Examiner*—Laura Tso
(74) *Attorney, Agent, or Firm*—Quinn Law Group, PLLC; Robert C. Corbett

(57) ABSTRACT

An apparatus for viewing an object through falling liquid includes structure defining a chamber for at least partially containing the object. At least one transparent or translucent member further defines the chamber. A conduit defines at least one hole positioned such that the transparent or translucent member is between the falling water and the chamber. The object is thus viewable by an observer through the falling liquid, and the member protects the object from the falling liquid.

11 Claims, 3 Drawing Sheets

DEVICE FOR VIEWING MEDIA THROUGH FALLING LIQUID

CROSS REFERENCE TO RELATED APPLICATION

This application claims the benefit of U.S. Provisional Patent Application No. 60/591,443, filed Jul. 27, 2004, and which is hereby incorporated by reference in its entirety.

TECHNICAL FIELD

The present invention relates to apparatuses for viewing media in a chamber through falling liquid.

BACKGROUND OF THE INVENTION

The sound and appearance of flowing water is often considered desirable. For example, many find the sound and appearance of flowing water to be relaxing or inspiring. Small fountains for home or office use employ a pump to recirculate water over real or artificial stones to provide the sound and appearance of flowing water indoors from a small, portable device.

SUMMARY OF THE INVENTION

An apparatus for viewing media is provided. The apparatus includes structure, such as a housing, that at least partially defines a chamber for containing the media. A panel exhibiting transparence or translucence further defines the chamber such that an observer can view the media through the panel. The apparatus also includes a conduit configured to convey liquid. The conduit has at least one hole through which the liquid can exit the conduit. The hole is sufficiently positioned such that the liquid, after exiting the hole, falls so that the panel is between the falling liquid and the chamber.

Thus, a waterfall is created between a viewer and the media. Examples of media include photographs, prints, paintings, sculpture, plants, etc. The media may also be electronic, such as a liquid crystal screen.

In an exemplary embodiment, a controller is configured to selectively vary the flow rate of the liquid exiting the hole to produce waves, pulses, etc. A light source may be mounted with respect to the structure and configured to illuminate the media inside the chamber and provide an aesthetic lighting effect outside the chamber.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
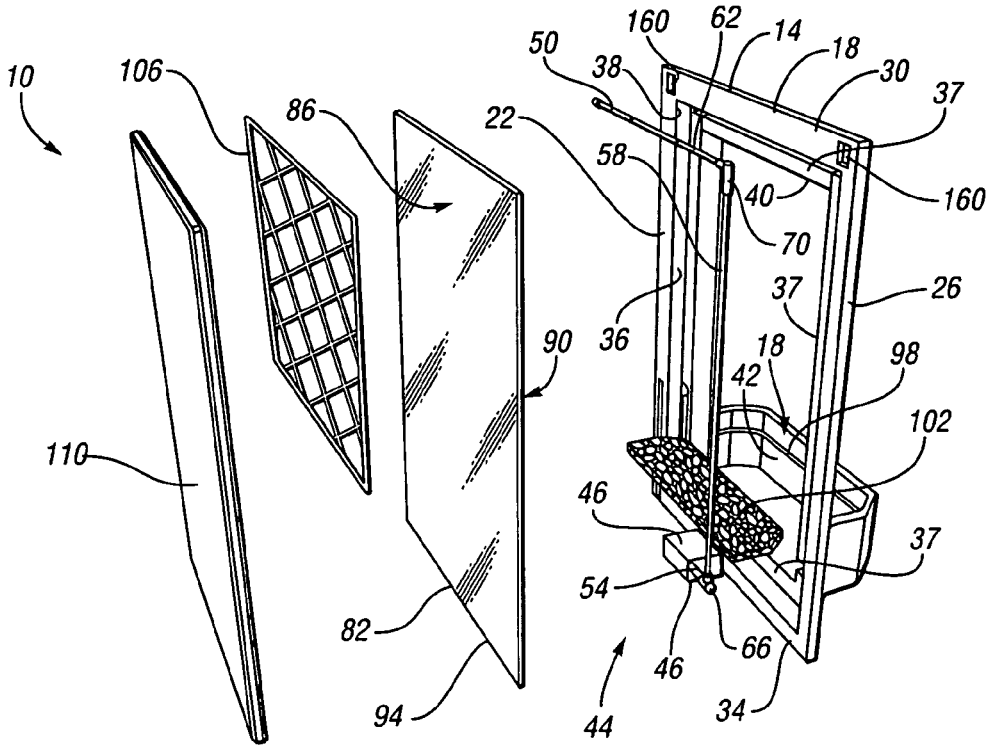
FIG. 1 is a schematic, perspective, exploded, rear view of a waterfall frame including a housing, a transparent panel, and a fluid circuit.
Figure 2:
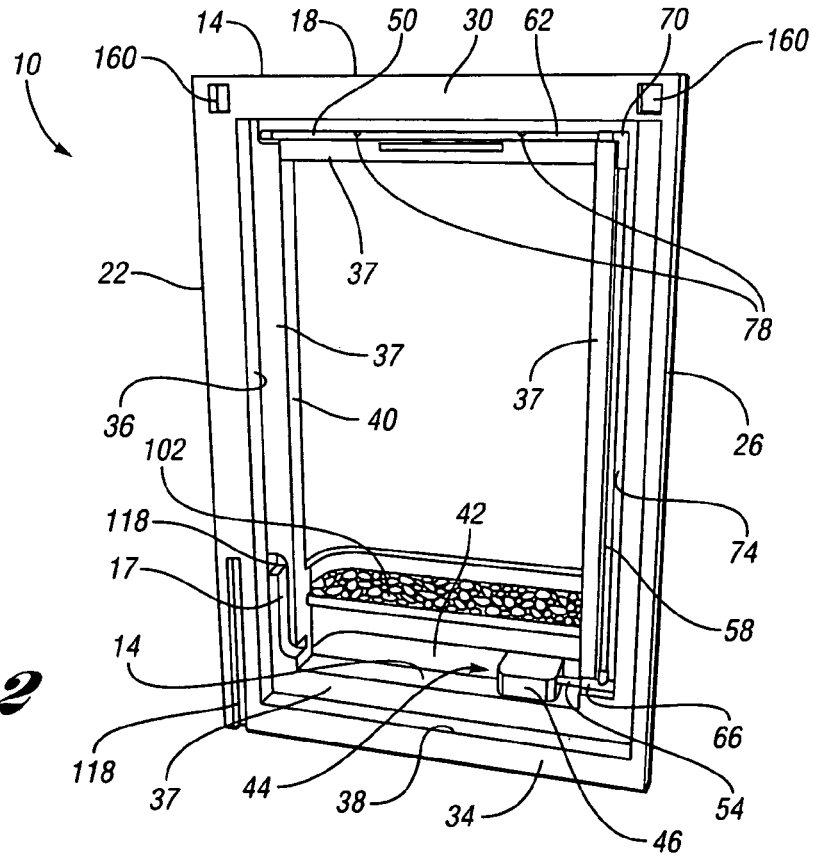
FIG. 2 is a schematic, perspective, rear view of the waterfall frame of FIG. 1 without the panel.
Figure 3:
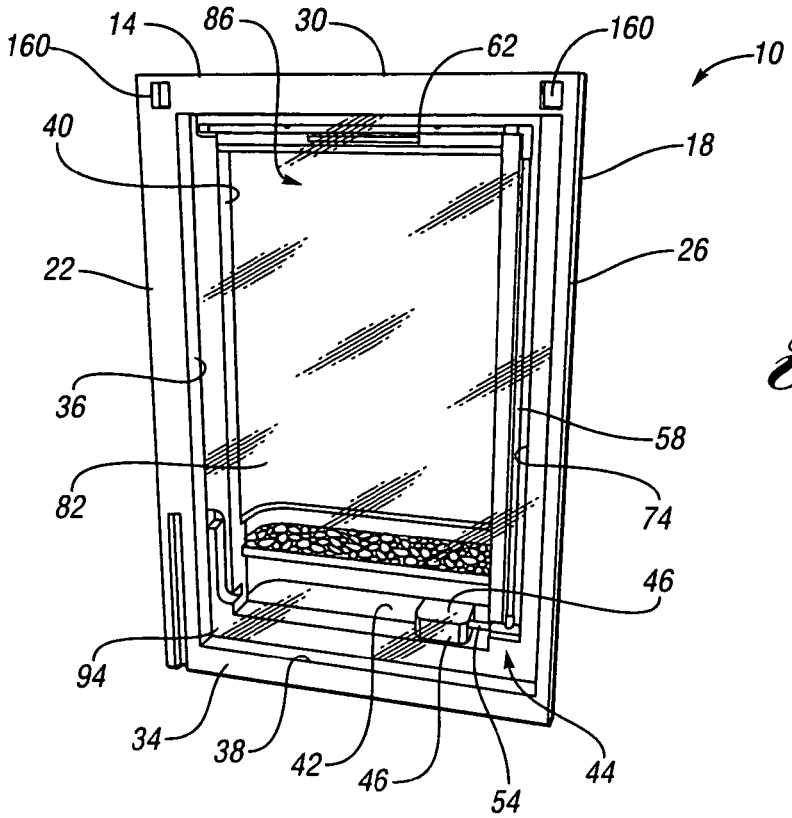
FIG. 3 is a schematic, perspective, rear view of the waterfall frame of FIG. 1 with the panel.

Referring to FIGS. 1-3, a waterfall frame 10 is schematically depicted. The waterfall frame includes a main housing 14. The housing 14 includes a frame portion 18 having first and second vertical portions 22, 26 spaced a distance apart from one another, and first and second horizontal portions 30, 34 that are spaced a distance apart from one another and that interconnect the first and second vertical portions 22, 26. Portions 22, 26, 30, 34 cooperate to partially define a chamber 36 therebetween. Each of the portions 22, 26, 30, 34 includes an inwardly extending lip 37; the lips 37 cooperate with each other to define an opening 40 therebetween. Portions 22, 26, 30, 34 also define opening 38 of the chamber 36. Openings 38, 40 are generally rectangular. The housing 14 also defines a reservoir 42 adjacent horizontal portion 34. The reservoir 42 is configured to store liquid such as water.

Those skilled in the art will recognize a variety of materials that may be used to form the housing 14 within the scope of the claimed invention, such as metals, woods, plastics, etc. In the embodiment depicted, the housing 14 is plastic formed in a mold having positive and negative cavities. The housing 14 in the embodiment depicted is one-piece; however, and within the scope of the claimed invention, the housing may be formed of multiple pieces joined together.

The waterfall frame 10 also includes a fluid circuit 44 having a pump 46 and a conduit 50. The conduit 50 in the embodiment depicted includes three sections 54, 58, 62 of pipe. Section 54 extends horizontally from pump 46 to section 58. Sections 54 and 58 are connected to each other for fluid communication therebetween with connector 66. Section 58 extends vertically from section 54 to section 62. Sections 58 and 62 are connected to each other for fluid communication therebetween by connector 70. Section 62 extends horizontally from section 58.

Referring specifically to FIGS. 2 and 3, the pump 46 is located within reservoir 42, and conduit 50 is located within a channel 74 formed in main housing 14. More specifically, pipe section 54 is in a generally horizontal portion of channel 74, pipe section 58 is located in a generally vertical portion of channel 74 formed by the lip 37 of housing portion 26, and pipe section 62 is located in a generally horizontal section formed by the lip 37 of housing portion 30. Pipe section 62 defines a plurality of holes 78.

Referring to FIGS. 1 and 3, the waterfall frame 10 includes a protective barrier, i.e., panel 82, that is generally transparent or translucent. Examples of transparent materials that may be utilized to form the panel 82 include glass, plexiglass, shatterproof glass, mirror, acrylic, etc. It may be desirable for the panel 82 to be characterized by properties such as reflection control, glazing, protective ultraviolet coatings, and frosting or etchings. The panel 82 has a first surface 86 and a second surface 90 opposite the first surface 86. The panel 82 is sufficiently sized and shaped such that the periphery 94 of the panel abuts lips 37 formed by the housing 14. Referring specifically to FIG. 3, the panel 82 completely obstructs opening 40 such that surface 86 further defines chamber 36. The panel 82 is adhesively bonded to the housing 14 such that the panel 82 completely separates opening 40 from chamber 36. It may be desirable to employ a gasket or elastic strip (not shown) between lips 37 and the panel 82 to provide a watertight seal between the housing 14 and the panel 82. Within the scope of the claimed invention, the waterfall frame 10 may include more than one panel 82. For example, a first panel may define surface 86 and a second panel may define surface 90.

Figure 4:
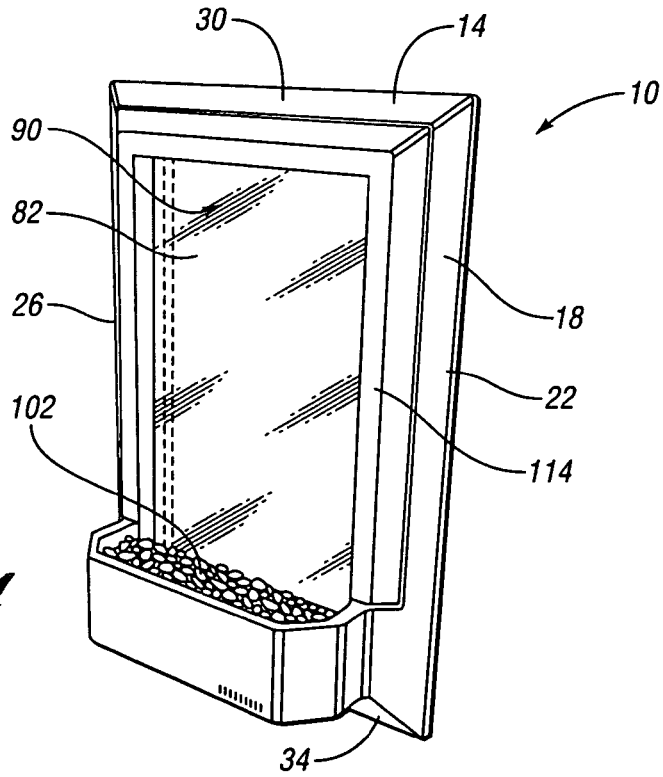
FIG. 4 is a schematic, perspective, front view of the waterfall frame of FIG. 1.

Referring specifically to FIG. 1, the housing 14 defines a ledge 98 adjacent the reservoir 42 for supporting shelf 102. Referring to FIGS. 2-4, the shelf 102 rests on the ledge such that it is suspended over the reservoir 42, thereby to conceal the pump 46 and to create a sound barrier for the pump.

Media, i.e., an object to be viewed through the panel 82, is shown schematically in FIG. 1 at 106. The media 106 is positioned within the chamber 36. Examples of media that may be employed in the waterfall frame 10 include a photographic image, digital media, sand, a painting, an illustration, a poster, digital projection, pixels, a screen, light emitting diodes (LEDs), a carving, a print, a sculpture, etc. Digital media may encompass screens such as liquid crystal display (LCD), organic light emitting diodes (OLEDs), plasma screens, projectors, etc.

A spacer (not shown) may be used to separate the media 106 from the panel 82. A backing member 110 is releasably attached to the housing 14 to obstruct opening 38 and thereby further define chamber 36. In exemplary embodiments, the media 106 may be mounted to the backing 110 or may be held in place by the backing 110. Exemplary backing members 110 include acid-free mat board, a foam core, corrugated cardboard, and plastic. The backing member 110 may be held to the housing 14 in any number of methods including adhesive, fasteners, spring clips, staples, pins, screws, nails, etc. The backing member 110 is optional, and it may be desirable to omit the backing member to provide air circulation if electronic media is displayed in the chamber 36.

The media 106 may or may not be mounted to a variety of materials including acid free mounting, foam core, and more. Borders and trim may or may not be applied. The media 106 is selectively interchangeable or replaceable inside the chamber 36. For example, backing member 110 may be removed to provide access to the chamber 36 to remove the media 106 and to replace it with other media. Alternatively, a slot may be formed in the housing 14, such as through frame portion 26, to provide access to media 106 in the chamber 36.

Referring specifically to FIG. 4, the front side of the frame 18 may include a piece of trim 114 to obscure the interface between the panel 82 and the lips (shown at 37 in FIG. 1). Referring again to FIG. 2, an electrical channel 118 is formed by housing 14. The channel 118 enables a power cord (not shown) to extend into the reservoir 42 for attachment to pump 46.

Figure 5:
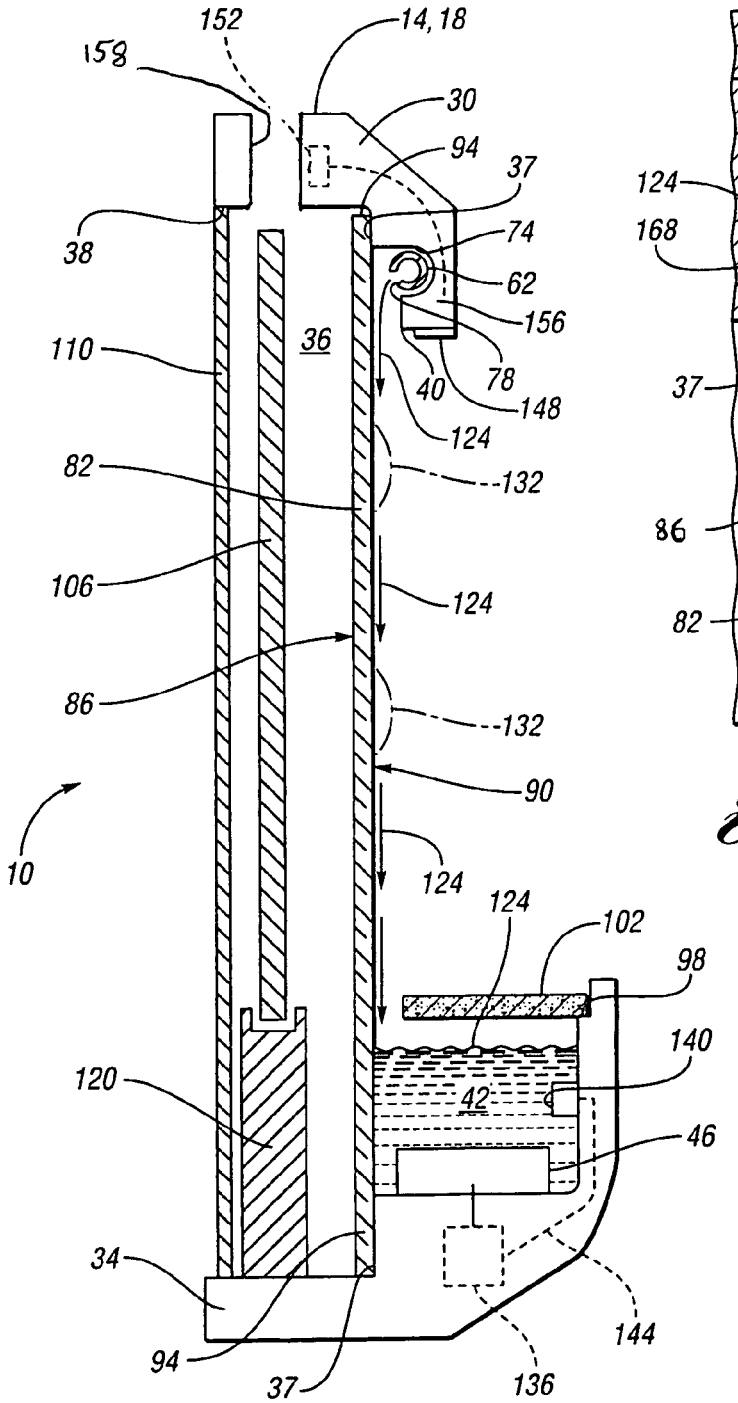
FIG. 5 is a schematic, cross-sectional view of the waterfall frame of FIG. 1 taken about a vertical plane.

Referring to FIG. 5, wherein like reference numbers refer to like components from FIGS. 1-4, the operation of the waterfall frame 10 is schematically depicted. Media 106 is located inside chamber 36, with backing member 110 secured to the main housing 14 to close opening 38. Surface 86 of the panel 82 partially defines chamber 36. In the embodiment depicted, the media 106 is elevated by a support member 120. It may be desirable for the media 106 to contact panel 82, and for the backing member 110 to contact the media 106 such that chamber 36 is significantly smaller in width. In another exemplary embodiment, the reservoir 42 may be below the chamber 36 to avoid the use of a support member 120 to elevate the media 106.

Water 124 is stored in the reservoir 42. The pump 46 pressurizes water 124 in the reservoir 42 and causes water to flow through the conduit (shown at 50 in FIGS. 1-3), which directs the water upward from the reservoir 42 to pipe segment 62. The pressurized water within pipe segment 62 exits the conduit through the holes 78, where the water 124 falls through the force of gravity back into the reservoir 42. More specifically, the water 124 exits the holes 78 and falls into the reservoir 42 such that the panel 82 is directly between the falling water 124 and the media 106. Thus, an observer of the media 106 views the media through the falling water 124.

In a preferred embodiment, the falling water 124 contacts surface 90 of the panel 82 as it descends from pipe segment 62 into the reservoir 42. In an exemplary embodiment, surface 90 of panel 82 is nonplanar. For example, the surface 90 may include features such as protuberances, shown in phantom at 132, over which the falling water 124 flows. Within the scope of the claimed invention, nonplanar surface features may be integrally formed in the panel 82, or may be separate members affixed to the panel 82. A gap is present between the shelf 102 and the panel 82 to allow the falling water 124 to pass into the reservoir 42.

Although water is used in the embodiment depicted, other liquids may be employed in the waterfall frame 10 within the scope of the claimed invention. For example, chemicals may be added to the water to prevent algae contamination. Water coloring may be added for aesthetic effect. A filtration system may be incorporated in the fluid circuit to keep fluids clean.

In a preferred embodiment, the waterfall frame 10 includes at least one controller. In the embodiment depicted, a first controller 136 is operatively connected to, and programmed to control, the pump 46. A sensor 140 is positioned within the reservoir 42 and is configured to monitor the amount of water 124 in the reservoir 42. The sensor 140 transmits a signal 144 to the controller 136 when the water level is below a predetermined amount to indicate that there is insufficient water for the pump 46 to operate. The controller 136 turns the pump 46 off in response to the signal 144 from the sensor 140. Alternatively, the sensor 140 may send a signal to a water source to supply water to the reservoir when the water level in the reservoir is below the predetermined amount.

The controller 136 may also be programmed to cause the pump 46 to vary the amount of water transmitted through the conduit with respect to time, thereby to cause waves or pulses of water to fall from holes 78. Water may be programmed to flow at certain times and in certain ways, patterns, shapes, and flow rates.

The waterfall frame 10 may also include a light source 148 mounted with respect to the housing and sufficiently positioned to illuminate the media 106 inside the chamber 36 and to provide lighting effects outside the chamber 36 through panel 82. Exemplary light sources 148 include incandescent bulbs, light-emitting diodes, etc. The light source 148 is connected to a second controller 152, which controls the light source 148. For example, the controller 152 may be programmed to selectively cause the light source 148 to change color, brightness, etc. The color or brightness may vary with respect to time to cause a strobe or pulse effect. Mood lighting can take the effect of setting the tone for a romantic dinner in a restaurant to an evening at home. Lighting may also be for illumination of plants that are either within chamber 36 or located outside the waterfall frame 10. Controllers 136 and 152 may be consolidated as a single controller. A timer (not shown) may be employed to cause the pump 46 and the light source 148 to turn on and off according to a user-defined schedule. In an alternative embodiment, the light source 148 is located within the reservoir 42.

The shelf 102 may also sustain weight where items like small stones or plants may be placed on top of it. The shelf may function as a sound barrier, splash absorber, and filter. The shelf may have holes or may be porous.

A guide 156 keeps the water uniform and flowing effectively down the panel 82 evenly. Any overfill of water that backs up inside the guide 156 can easily drain through the channel 74 into the reservoir 42.

Referring again to FIGS. 1-3, the frame includes features for enabling the waterfall frame to be hung on a wall. More specifically, the frame defines cavities 160 into which nails or other hangers may be inserted for supporting the waterfall frame on a wall. Alternatively, the waterfall frame may be configured for placement on a horizontal surface such as a table top. Furthermore, the panel 82 may be tilted so as to be non-vertical. In the context of the present invention, water "falls" when its velocity vector has a downward component.

Optionally, housing portion 30 defines a slot 158 through which the media 106 may be inserted into the chamber 36, and through which media 106 may be removed from the chamber 36. A member (not shown) may be attached to the media 106 and extend upward into or through slot 158 to facilitate removal of the media.

The transparency of the panel 82 may be selectively variable. For example, the panel 82 may be configured such that the opacity of the panel 82 is responsive to an electronic charge.

Figure 6:
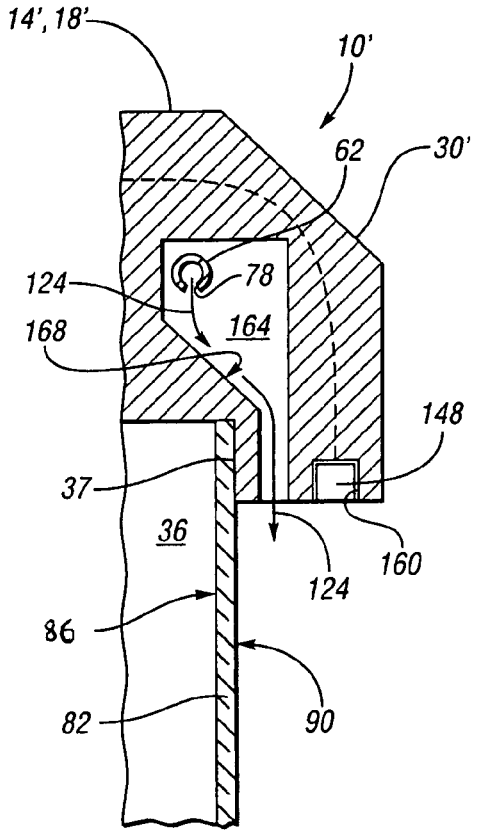
FIG. 6 is a schematic, cross-sectional view of an alternative waterfall frame taken about a vertical plane.

Referring to FIG. 6, wherein like reference numbers refer to like components from FIGS. 1-5, a waterfall frame 10' having an alternative housing 14' design is schematically depicted. Portion 30' of the frame 18' defines a chamber 164 through which pipe segment 62 extends. The chamber 164 extends substantially the entire length of the pipe segment 62. The chamber 164 is obscured from view, and is partially defined by an inclined surface 168. Holes 78 in pipe segment 62 are positioned such that water 124 falls onto surface 168 prior to falling such that the panel 82 is between the falling water and the chamber 36. By flowing along surface 168, the water 124 from holes 78 is more evenly spread across the panel 82. The flow rate of water 124 from holes 78 may be such that water accumulates inside the chamber 164, whereby chamber 164 functions as a reservoir. Within the scope of the claimed invention, a reservoir formed above the panel 82 may be a "conduit" with a hole therein for conveying liquid. Moreover, a hole in the conduit may be any size or shape within the scope of the claimed invention. For example, and within the scope of the claimed invention, a hole 78 may be an elongated slot formed in pipe segment 62.

Light source 148 is shown situated in a cavity 160 defined by housing portion 30'.

While the best modes for carrying out the invention have been described in detail, those familiar with the art to which this invention relates will recognize various alternative designs and embodiments for practicing the invention within the scope of the appended claims.

The invention claimed is:

1. An apparatus for viewing media, the apparatus composing:

a frame portion at least partially defining a chamber for containing the media, the frame portion including four lips that cooperate to define a rectangular opening therebetween the;

a panel exhibiting transparence or translucence and further defining the chamber, said panel overlapping at least three of the four lips to separate the chamber from the opening; and a conduit configured to convey liquid and defining at least one hole through which the liquid can exit the conduit, said at least one hole being sufficiently positioned such that the liquid, after exiting said at least one hole, falls so that the panel is between the falling liquid and the chamber.

2. The apparatus of claim 1, further comprising structure defining a reservoir for storing liquid and sufficiently positioned to collect the liquid after exiting said at least one hole; a fluid circuit including a pump in fluid communication with the reservoir and configured to pressurize liquid in the conduit; and structure separating the reservoir and the chamber.

3. The apparatus of claim 2, further comprising a sensor configured to detect when the amount of liquid in the reservoir is below a predetermined amount, and a control apparatus configured to deactivate the pump when the sensor detects that the amount of liquid in the reservoir is below the predetermined amount.

4. The apparatus of claim 2, further comprising a controller operatively connected to the pump and configured to control the pump to vary the flow rate of liquid in the conduit.

5. The apparatus of claim 1, wherein the panel includes a nonplanar surface, and wherein said at least one hole is sufficiently positioned such that the liquid, after exiting said at least one hole, flows along the nonplanar surface.

6. The apparatus of claim 1, further comprising a light source configured to illuminate the media in the chamber.

7. The apparatus of claim 6, further comprising a controller configured to selectively control the light source to vary the brightness or color of the light.

8. An apparatus comprising:

at least one transparent or translucent member having a first side and a second side opposite the first side;

a housing cooperating with the first side of said at least one panel to at least partially define a chamber for containing a viewable object;

a reservoir configured to contain a liquid;

structure separating the reservoir from the chamber;

a pump configured to pressurize the liquid;

a conduit configured to convey pressurized liquid from the pump to an outlet;

wherein the outlet is configured and positioned to direct water to the second side of said at least one panel so that water falls on the second side of said at least one panel.

9. The apparatus of claim 8, further comprising: a backing being selectively, releasably mutable with the housing to further define the chamber.

10. The apparatus of claim 8, further comprising a light source mounted with respect to the housing and configured to illuminate the chamber.

11. The apparatus of claim 8, wherein the housing defines a slot through which the viewable object can be inserted and removed from the chamber.

* * * * *